US006343702B1

(12) United States Patent
Masumoto et al.

(10) Patent No.: US 6,343,702 B1
(45) **Date of Patent: *Feb. 5, 2002**

(54) CRANE APPARATUS

(75) Inventors: Masanori Masumoto; Hisanori Abiru; Tetsuo Ichikizaki; Takashi Chikura; Tatsuya Hirano; Shinichi Masumoto; Ikko Yasunaga; Takashi Okada, all of Hiroshima (JP)

(73) Assignee: Mitsubishi Heavy Industries, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/592,931

(22) Filed: Jun. 13, 2000

(30) Foreign Application Priority Data

Aug. 12, 1999 (JP) ..... 11-228184
Jan. 12, 2000 (JP) ..... 2000-003258

(51) Int. Cl.[7] ..... B66C 17/00
(52) U.S. Cl. ..... 212/274; 212/322

(58) Field of Search ..... 212/320–323, 212/274

(56) References Cited

U.S. PATENT DOCUMENTS 4,883,184 A * 11/1989 Albus ..... 212/274

FOREIGN PATENT DOCUMENTS

| | | | | |
|---|---|---|---|---|
| DE | 2703384 | * | 8/1977 | ..... 212/274 |
| FR | 2455560 A | | 11/1980 | |
| WO | 99/28230 | * | 6/1999 | ..... 212/274 |

* cited by examiner

*Primary Examiner*—Thomas J. Brahan

(57) ABSTRACT

A crane apparatus is disclosed. First traverser wire ropes are connected to a right connecting portion of a traverser, while second traverser wire ropes are connected to a left connecting portion of the traverser. First hoisting accessory wire ropes are passed over a right rope pulley via the traverser, and then connected to the traverser, while second hoisting accessory wire ropes are passed over a left rope pulley via the traverser, and then connected to the traverser. A hoisting accessory is suspended from the right and left rope pulleys. The crane apparatus enlarges the traversing range of the hoisting accessory, and increases work efficiency, without becoming upsized.

5 Claims, 5 Drawing Sheets

CRANE APPARATUS

BACKGROUND OF THE INVENTION

1. Field of the Invention

The present invention relates to a crane apparatus which is used, for example, as a transfer crane of port cargo handling equipment.

2. Description of the Related Art

A conventional transfer crane has a gantry-shaped body frame, which can travel by a plurality of traveling wheels. On the top of the body frame, a trolley can move transversely. On the trolley, a rotationally drivable takeup drum is connected. A hoisting accessory is attached to the lower end of a plurality of load suspending wire ropes wound off from the takeup drum. Thus, as the trolley moves on the body frame, a suspended load held by the hoisting accessory can be traversed. When the takeup drum is rotationally driven at a predetermined stop position of the trolley to take up or pay out the plural wire ropes, the suspended load can be moved upwards or downwards.

With the above-described conventional crane apparatus, rails are provided on transverse girders placed on the body frame, and the trolley is supported on the rails. In con sideration of the weight of the rails, the weight of the trolley, or the weight of the suspended load imposed on the hoisting accessory, not only the transverse girders and the body frame, but also the entire crane apparatus must have great rigidity, inducing a large size and a heavy weight. When the trolley is moved laterally and stopped at a predetermined position, with the suspended load being held by the hoisting accessory, sway occurs in the hoisting accessory and the suspended load owing to an inertial force in the lateral direction. This sway does not settle quickly. To prevent sway of the hoisting accessory and the suspended load when the trolley stops, the trolley has to be moved at a slow speed. Since a long time is required for work, the work efficiency is low.

As a solution to the above-mentioned problem, a crane apparatus as shown, for example, in FIG. 4 is available. It should be noted that the numbering scheme for FIG. 4 and all other figures uses the numbers (n, n') to designate pairs of like parts disposed orthogonally to the plane of the two-dimensional figure. In this conventional crane apparatus, as shown in FIG. 4, a pair of left and a pair of right traverser drums 101, 101' and 102, 102', and a pair of left and a pair of right hoisting accessory drums 103, 103' and 104, 104' are rotatably supported on the top of a gantry or portal body frame via pairs of clutches 105, 105' and 106, 106', respectively, and are rotationally drivable by a pair of left and a pair of right drive motors 107, 107' and 108, 108'. A first pair of right and a first pair of left traverser wire ropes 109, 109' and 110, 110' have first ends taken up by the traverser drums 102, 102' and 101, 101' and have the other ends connected to pairs of right connecting portion 114 on a traverser 113, 113' via pairs of right and left sheaves 111, 111' and 112, 112', respectively. Second pairs of right and left traverser wire ropes 115, 115' and 116, 116' have an end taken up by the traverser drums 102, 102' and 101, 101, and have other ends connected to a pair of left connecting portions 119, 119' on the traverser 113 via pairs of right and left sheaves 117, 117' and 118, 118', respectively. Furthermore, pairs of right and left hoisting accessory wire ropes 120, 120' and 121, 121' have first ends taken up by the hoisting accessory drums 104, 104' and 103, 103' and have the other ends passed over low-position rope pulleys 126, 126' and 127, 127' via right and left sheaves 122, 122' and 123, 123' and right and left sheaves 124, 124' and 125, 125' of the traverser 113, and then connected to connecting portions 128, 128' and 129, 129' of the traverser 113. From the rope pulleys 126, 126' and 127, 127', a hoisting accessory 130 capable of holding a container C is suspended. Hence, there is no need to provide rails and a trolley on the body frame. Since the weight on the body frame is reduced, the crane apparatus can be made compact and light-weight. Besides, the traverser 113, which supports the hoisting accessory 130, is supported by the wire ropes 109, 109', 110, 110', 115, 115', 116, 116' at the two separated connecting portions 114, 114' and 119, 119'. Hence, sway of the hoisting accessory 130 and the suspended load C due to their inertial force is suppressed, and the work efficiency is increased.

In the conventional crane apparatus described above, let the weight of the hoisting accessory 130 and the suspended load C be W. Then, the rope tension T of the hoisting accessory wire ropes 120, 120' and 121, 121' will be:

$$T=W/4$$

The rope tensions $T_{1R}$ and $T_{1L}$ of the first traverser wire ropes 109 and 110, and the rope tensions $T_{2R}$ and $T_{2L}$ of the second traverser wire ropes 115 and 116 will be given by:

$$T_{1R}=(W/2)\cos\theta_2/\sin(\theta_1+\theta_2)-W/8$$

$$T_{1L}=(W/2)\cos\theta_1/\sin(\theta_1+\theta_2)-W/8$$

$$T_{2R}=T_{1R}$$

$$T_{2L}=T_{1L}$$

where $\theta_1$ is the angle of each of the wire ropes 109, 115 and 120, and $\theta_2$ is the angle of each of the wire ropes 110, 116 and 121.

In other words, the rope tensions $T_{1R}$ and $T_{1L}$ of the first traverser wire ropes 109, 109' and 110, 110', and the rope tensions $T_{2R}$ and $T_{2L}$ of the second traverser wire ropes 115, 115' and 116, 116' vary with the angle $\theta_1$ of each of the wire ropes 109, 109', 115, 115' and 120, 120', and the angle $\theta_2$ of each of the wire ropes 110, 110', 116, 116' and 121, 121', namely, the traversing position of the hoisting accessory 130. Whereas the rope tension T of each of the hoisting accessory wire ropes 120, 120' and 121, 121' is constant (W/4) regardless of the traversing position of the hoisting accessory 130.

Under these situations, when the hoisting accessory 130 is traversed most rightward, the hoisting accessory 130 stops at a position at which rightward and leftward horizontal components of force from the hoisting accessory wire ropes 120 and 121 are balanced, as shown in FIG. 5, because the rope tension T of the hoisting accessory wire ropes 120, 120' and that of the hoisting accessory wire ropes 121, 121' are the same. Thus, the hoisting accessory 130 cannot be brought fully close to a crane leg 131 which supports the sheaves 122, 122', etc. As a result, the traversing range of the hoisting accessory 130 narrows. A full traversing function of the crane cannot be exhibited, and the work efficiency is low. If the position of the crane leg 131 is brought outward (rightward in FIG. 5), together with the sheaves 122, 122', to enlarge the traversing range of the hoisting accessory 130, the apparatus will be upsized.

SUMMARY OF THE INVENTION

The present invention has been accomplished to solve the above-described problems with the earlier technology. It is an object of this invention to provide a crane apparatus designed to increase the work efficiency by enlarging the traversing range of a hoisting accessory without upsizing the apparatus.

A first aspect of the present invention, as a means of attaining the above object, is a crane apparatus comprising:

traverser drums and hoisting accessory drums rotatably mounted on a support and normally and reversely rotatable by drive motors;

a traverser having a pair of right and a pair of left connecting portions, and a pair of right and a pair of left sheaves thereon;

a right pair of and a left pair of rope pulleys positioned below the traverser;

a first pair of right and a first pair of left traverser wire ropes each having an end taken up by the traverser drums, and each having another end connected to the right pair of connecting portions of the traverser;

a second pair of right and a second pair of left traverser wire ropes having an end taken up by the traverser drums, and having another end connected to the left pair of connecting portions of the traverser;

a first pair of right and a first pair of left hoisting accessory wire ropes, each rope having an end taken up by the hoisting accessory drums, and having another end passed over one of the right pair of rope pulleys via one of the right pair of sheaves of the traverser and then connected to the traverser;

a second pair of right and a second pair of left hoisting accessory wire ropes, each rope having an end taken up by the hoisting accessory drums, and having another end passed over one of the left pair of rope pulleys via one of the left pair of sheaves of the traverser and then connected to the traverser;

a pair of right and a pair of left traverser sheaves and a pair of right and a pair of left hoisting accessory sheaves for guiding the right pair of wire ropes to be parallel and the left pair of wire ropes to be parallel; and a hoisting accessory capable of attaching and detaching a load thereto and therefrom, and suspended from the right and left pair of rope pulleys.

Thus, the rope tension o f each of the hoisting accessory wire ropes varies with the traversing position of the hoisting accessory as does the rope tension of each of the traverser wire ropes. When the hoisting accessory comes to a terminal area in a traversing direction, the position at which the rightward and leftward horizontal components of force are balanced is more outward than in the earlier technology. Thus, the traversing range of the hoisting accessory widens. As noted from this, the traversing range of the hoisting accessory can be enlarged, and the work efficiency can be increased, without the need to upsize the apparatus.

In the crane apparatus as the first aspect of the invention, the hoisting accessory drums may be drivably connected to the drive motor, and the traverser drums may be drivably connected to the hoisting accessory drums via clutches. Consequently, the hoisting accessory drums may be driven independently to permit only the hoisting and lowering of the hoisting accessory.

A second aspect of the invention is a crane apparatus comprising:

traverser drums and hoisting accessory drums rotatably mounted on a support and normally and reversely rotatable by drive motors;

a traverser having a pair of right and a pair of left connecting portions, and a pair of right and a pair of left sheaves thereon;

a pair of right and a pair of left rotating drums suspended from the traverser;

a first pair of right and a first pair of left traverser wire ropes, each rope having an end taken up by the traverser drums, and each rope having another end connected to the right pair of connecting portions of the traverser;

a second pair of right and a second pair of left traverser wire ropes, each rope having an end taken up by the traverser drums, and each rope having another end connected to one of the left pair of connecting portions of the traverser;

a first pair of right and a first pair of left hoisting accessory wire ropes, each rope having an end taken up by the hoisting accessory drums, and each rope having another end passed over one of the right rotating drums via one of the right pair of sheaves of the traverser;

a second pair of right and a second pair of left hoisting accessory wire ropes, each rope having an end taken up by the hoisting accessory drums, and each rope having another end passed over one of the left pair of rotating drums via the left pair of sheaves of the traverser;

a pair of right and a pair of left traverser sheaves and a pair of right and a pair of left hoisting accessory sheaves for guiding the right pair of wire ropes to be parallel and the left pair of wire ropes to be parallel; and a hoisting accessory capable of attaching and detaching a load thereto and therefrom, and connected to the respective pairs of right and left suspending wire ropes paid out from the respective right and left pair of rotating drums.

Thus, the rope tension of each of the hoisting accessory wire ropes varies with the traversing position of the hoisting accessory as does the rope tension of each of the traverser wire ropes. When the hoisting accessory comes to a terminal area in a traversing direction, the position at which the rightward and leftward horizontal components of force are balanced is more outward than in the earlier technology. Thus, the traversing range of the hoisting accessory widens. As noted from this, the traversing range of the hoisting accessory can be enlarged, and the work efficiency can be increased, without the need to upsize the apparatus.

In the crane apparatus as the second aspect of the invention, the hoisting accessory drums may be drivably connected to the drive motor, and the traverser drums may be drivably connected to the hoisting accessory drums via clutches. Consequently, the hoisting accessory drums may be driven independently to permit only the hoisting and lowering of the hoisting accessory.

In the crane apparatus as the second aspect of the invention, moreover, the hoisting accessory wire ropes and the suspending wire ropes may be passed over the rotating drum in opposite directions. Consequently, smooth actions can be performed.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Embodiments of the present invention will now be described in detail with reference to the accompanying drawings.

Figure 1:
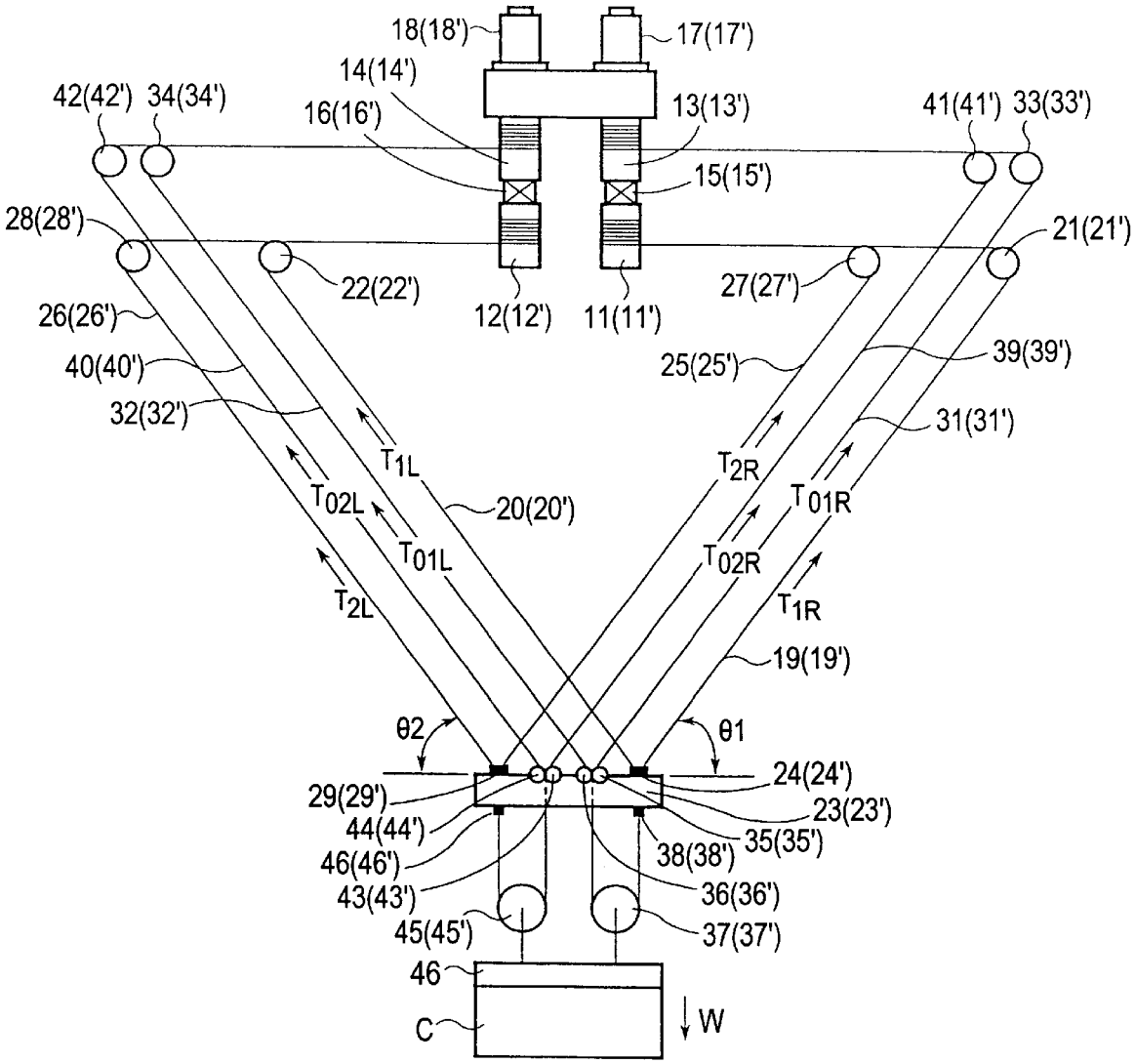
FIG. 1 is a schematic constitution drawing of a crane apparatus according to a first embodiment of the present invention.

FIG. 1 schematically shows the constitution of a crane apparatus according to a first embodiment of the invention. Orthogonally disposed pairs of like parts are designated by numbered pairs (n, n').

[First Embodiment]

In the crane apparatus of the present embodiment, as shown in FIG. 1, a body frame (not shown) is shaped like a gantry. On the top of the body frame, pairs of right and left traverser drums 11, 11' and 12, 12' and right and left hoisting accessory drums 13, 13' and 14, 14' are rotatably supported via clutches 15, 15' and 16, 16', and are rotationally drivable by right and left drive motors 17, 17' and 18, 18'. First, right and left traverser wire ropes 19, 19' and 20, 20' have an end taken up by the traverser drums 11 and 12, and have the other end connected to right connecting portions 24, 24' of a traverser 23, 23' via right and left sheaves 21, 21' and 22, 22'. Pairs of second right and left traverser wire ropes 25, 25' and 26, 26' have first ends taken up by the traverser drums 11, 11' and 12, 12', and have the other ends connected to left connecting portions 29, 29' of the traverser 23, 23' via right and left sheaves 27, 27' and 28, 28'.

Pairs of first right and left hoisting accessory wire ropes 31, 31' and 32, 32' have first ends taken up by the hoisting accessory drums 13, 13' and 14, 14', and have the other ends passed over lower-position rope pulleys 37, 37' via right and left sheaves 33, 33' and 34, 34' and right sheaves 35, 35', 36, 36' of the traverser 23 and then connected to connecting portions 38, 38' of the traverser 23. Pairs of second right and left hoisting accessory wire ropes 39, 39' and 40, 40' have first ends taken up by the hoisting accessory drums 13, 13' and 14, 14', and have other ends passed over lower-position rope pulleys 45, 45' via right and left sheaves 41, 41' and 42, 42' and left sheaves 43, 43', 44, 44' of the traverser 23 and then connected to connecting portions 46, 46' of the traverser 23. A hoisting accessory 47 capable of holding a container C is suspended from the rope pulleys 37, 37', 45, 45'. The right-hand wire ropes 19, 19', 25, 25', 31, 31', 39, 39' are parallel to each other, and the left-hand wire ropes 20, 21', 26, 26', 32, 32', 40, 40' are also parallel to each other.

The clutches 15, 15', 16, 16' are disengaged, and the hoisting accessory drums 13, 13' and 14, 14' are rotated in opposite directions by the drive motors 17, 17' and 18, 18'. When the hoisting accessory wire ropes 31, 31', 32, 32', 39, 39', 40, 40' are taken up in this state, the container C held by the hoisting accessory 47 can be lifted via the rope pulleys 37, 37', 45, 45'. By paying out the hoisting accessory wire ropes 31, 31', 32, 32', 39, 39', 40, 40', on the other hand, the container C held by the hoisting accessory 47 can be lowered via the rope pulleys 37, 37', 45, 45'. Alternatively, the clutches 15, 15', 16, 16' are engaged, and the respective drums 11, 11', 12, 12', 13, 13' and 14, 14' are rotated in the same direction by the drive motors 17, 17' and 18, 18'. When the hoisting accessory wire ropes 31, 31', 39, 39' and the traverser wire ropes 19, 19', 25, 25' are taken up in this state, and at the same time the hoisting accessory wire ropes 32, 32', 40, 40' and the traverser wire ropes 20, 20', 26, 26' are paid out, the container C held by the hoisting accessory 47, 47' can be caused to traverse rightward along with the traverser 23. On the other hand, when the hoisting accessory wire ropes 31, 31', 39, 39' and the traverser wire ropes 19, 19', 25, 25' are paid out, and at the same time the hoisting accessory wire ropes 32, 32', 40, 40' and the traverser wire ropes 20, 20', 26, 26' are taken up, the container C held by the hoisting accessory 47 can be caused to traverse leftward along with the traverser 23.

In the crane apparatus of the present embodiment, let the total weight of the hoisting accessory 47 and the container C be W. Then, the rope tensions $T_{01R}$, $T_{01L}$, $T_{02R}$ and $T_{02L}$ of the hoisting accessory wire ropes 31, 31', 32, 32', 39, 39' and 40, 40' vary with the traversing position of the hoisting accessory 47 (container C). That is, $$T_{01R}+T_{01L}W/4 \text{ . . . Balance in vertical direction} \quad (1)$$

$$T_{01R}\cos\theta_1-T_{01L}\cos\theta_2=0 \text{ . . . Balance in horizontal direction} \quad (2)$$

The equation (2) can be transposed as follows:

$$T_{01L}=T_{01R}\cos\theta_1/\cos\theta_2 \quad (3)$$

Substituting the equation (3) in the equation (1), followed by transposition, gives:

$$T_{01R}+T_{01R}\cos\theta_1/\cos\theta_2=W/4$$

$$T_{01R}=(W/4)\cos\theta_2/(\cos\theta_1+\cos\theta_2) \quad (4)$$

Substitution of the equation (3) into the equation (4), followed by transposition, yields:

$$T_{01L}=(W/4)\cos\theta_1/(\cos\theta_1+\cos\theta_2) \quad (5)$$

Also, $T_{02R}=T_{01R}$, and $T_{02L}=T_{01L}$

In the above equations, $\theta_1$ is the angle of each of the wire ropes 19, 19', 25, 25', 31, 31' and 39, 39', while $\theta_2$ is the angle of each of the wire ropes 20, 20', 26, 26', 32, 32' and 40, 40'.

The rope tensions $T_{1R}$, $T_{1L}$, $T_{2R}$, and $T_{2L}$ of the traverser wire rope pairs 19, 19', 20, 20', 25, 25' and 26, 26' also vary with the traversing position of the hoisting accessory 47 (container C). That is, $$T_{1R}\sin\theta_1+T_{1L}\sin\theta_2+T_{01R}\sin\theta_1+T_{01L}\sin\theta_2=W/2 \text{ . . . Balance in vertical direction} \quad (6)$$

Substituting the aforementioned equations (4) and (5) into the equation (6), followed by transposition, yields:

$$T_{1R}\sin\theta_1+T_{1L}\sin\theta_2=(W/2)[1-(½)(\sin(\theta_1+\theta_2)(\cos\theta_1+\cos\theta_2))] \quad (7)$$

Furthermore, $$T_{1R}\cos\theta_1-T_{1L}\cos\theta_2=0 \text{ . . . Balance in horizontal direction} \quad (8)$$

Substitution of the equation (7) in the equation (8), followed by transposition, gives:

$$T_{1R}=(W/2)\cos\theta_2/\sin(\theta_1+\theta_2)\ (W/4)\cos\theta_2/(\cos\theta_1+\cos\theta_2) \quad (9)$$

$$T_{1L}=(W/2)\cos\theta_1/\sin(\theta_1+\theta_2)\ (W/4)\cos\theta_1/(\cos\theta_1+\cos\theta_2) \quad (10)$$

Also, $T_{2R}=T_{1R}$, and $T_{2L}=T_{1L}$

As described above, the rope tensions $T_{01R}$, $T_{01L}$, $T_{02R}$ and $T_{02L}$ of the hoisting accessory wire ropes 31, 31', 32, 32', 39, 39' and 40, 40' vary with the traversing position of the hoisting accessory 47 (container C) as do the rope tensions $T_{1R}$, $T_{1L}$, $T_{2R}$ and $T_{2L}$ of the traverser wire ropes 19, 19', 20, 20', 25, 25' and 26, 26'. That is, when the hoisting accessory 47 is caused to traverse most rightward, the rope angle $\theta_1$ increases, and the rope angle $\theta_2$ decreases. Thus, the tensions of the right-hand wire ropes 19, 19', 25, 25', 31, 31' and 39, 39' increase, while the tensions of the left-hand wire ropes 20, 20', 26, 26', 32, 32' and 40, 40' decrease. As a result, the leftward horizontal component of force on the hoisting accessory 47 (container C) becomes smaller than in the earlier technology, and the position at which the rightward and leftward horizontal components of force are balanced comes more rightward than in the earlier technology. Hence, the hoisting accessory 47 (container C) can be brought fully close to the crane leg as compared with the earlier technology. The traversing range of the hoisting accessory 47 widens, and the work efficiency of the crane can be increased without the necessity of upsizing the apparatus.

[Second Embodiment]

Figure 2:
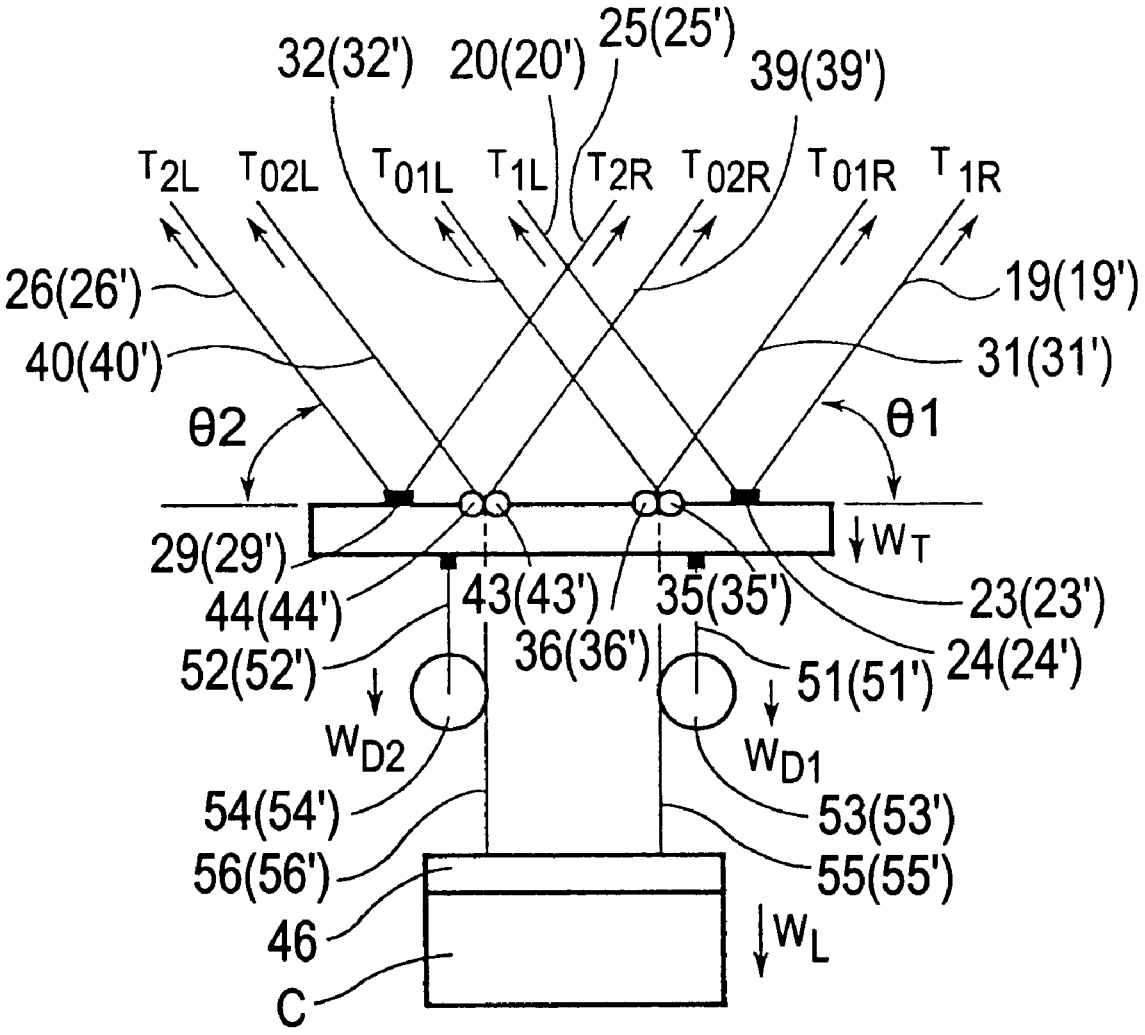
FIG. 2 is a schematic constitution drawing of a crane apparatus according to a second embodiment of the invention.

FIG. 2 schematically shows the constitution of a crane apparatus according to a second embodiment of the invention. Members having the same functions as explained in the above-mentioned embodiment will be assigned the same reference numerals, and overlapping explanations will be omitted. As with FIG. 1, the parts designated by numbering system (n, n') represent pairs of parts disposed orthogonally to the plane of the drawings.

In the crane apparatus of the present embodiment, pairs of right and left rotating drums 53, 53' and 54, 54' are supported in a suspended manner from a traverser 23, 23' by ropes 51, 51' and 52, 52', as shown in FIG. 2. First right and left hoisting accessory wire ropes 31, 31' and 32, 32' have other ends passed over the right rotating drum 53, 53' via right sheaves 35, 35', 36, 36' of the traverser 23, 23', and connected to the right rotating drum 53, 53'. Pairs of second right and left hoisting accessory wire ropes 39, 39' and 40, 40' have other ends passed over the left rotating drum 54 via left sheaves 43, 43', 44, 44' of the traverser 23, 23', and connected to the left rotating drums 54, 54'. A hoisting accessory 47 capable of holding a container C is suspended from the lower end of pairs of right and left suspending wire ropes 55, 55' and 56, 56' paid out from the rotating drums 53, 53' and 54, 54'. The takeup directions of the hoisting accessory wire ropes 31, 31', 32, 32', 39, 39', 40, 40' and the suspending wire ropes 55, 56 on the rotating drums 53, 53', 54, 54' are the same. Hence, when only hoisting accessory drums (not shown) are rotated for a takeup action, the hoisting accessory wire ropes 31, 31', 32, 32', 39, 39', 40, 40' are taken up to rotate the rotating drums 53, 53', 54, 54'. These rotating drums 53, 53' and 54, 54' take up the suspending wire ropes 55, 55' and 56, 56', whereby the container C held by the hoisting accessory 47 can be hoisted.

Alternatively, the hoisting accessory wire ropes 31, 31', 32, 32', 39, 39', 40, 40' are paid out to rotate the rotating drums 53, 53', 54, 54'. The rotating drums 53, 53', 54, 54' pay out the suspending wire ropes 55, 55', 56, 56', whereby the container C held by the hoisting accessory 47 can be lowered. The traversing action of the hoisting accessory 47 is the same as in the preceding embodiment, so that its explanation is omitted.

In the crane apparatus of the present embodiment, too, let the total weight of the hoisting accessory 47 and the container C be $W_L$, the weight of the traverser 23 be $W_T$, and the weights of the rotating drums 53 and 54 be $W_{D1}$, and $W_{D2}$. Then, the rope tensions $T_{01R}$, $T_{01L}$, $T_{02R}$ and $T_{02L}$ of the hoisting accessory wire ropes 31, 32, 39 and 40 vary with the traversing position of the hoisting accessory 47 (container C). That is, $$T_{01R}+T_{01L}=W_L/2 \text{ . . . Balance in vertical direction} \quad (11)$$

$$T_{01R}\cos\theta_1-T_{01L}\cos\theta_2=0 \text{ . . . Balance in horizontal direction} \quad (12)$$

The equation (12) can be transposed as follows:

$$T_{01L}=T_{01R}\cos\theta_1/\cos\theta_2 \quad (13)$$

Substituting the equation (13) in the equation (11) followed by transposition, gives:

$$T_{01R}=(W_L/2)\cos\theta_2/(\cos\theta_1+\cos\theta_2) \quad (14)$$

Substitution of the equation (13) into the equation (14), followed by transposition, yields:

$$T_{01L}=(W_L/2)\cos\theta_1/(\cos\theta_1+\cos\theta_2) \quad (15)$$

Also, $T_{02R}=T_{01R}$, and $T_{02L}=T_{01L}$

The rope tensions $T_{1R}$, $T_{1L}$, $T_{2R}$ and $T_{2L}$ of the traverser wire ropes 19, 20, 25 and 26 also vary with the traversing position of the hoisting accessory 47 (container C). That is, $$T_{1R}\sin\theta_1+T_{1L}\sin\theta_2=(W_T+W_{D1}+W_{D2})/2+(W_L/2-T_{01R}\sin\theta_1-T_{01L}\sin\theta_2) \text{ . . . Balance in vertical direction} \quad (16)$$

Furthermore, $$T_{1R}\cos\theta_1-T_{1L}\cos\theta_2=0 \text{ . . . Balance in horizontal direction} \quad (17)$$

$$T_{1L}=T_{1R}\cos\theta_1/\cos\theta_2 \quad (18)$$

Based on the equations (16) and (18), the same calculations as in the aforementioned embodiment are made, giving:

$$T_{1R}=\{(W_L+W_T+W_{D1}+W_{D2})/2)\}\cos\theta2/\sin(\theta_1+\theta_2)\ (W_L/2)\cos\theta_2/(\cos\theta_1+\cos\theta_2) \quad (19)$$

$$T_{1L}=\{(W_L+W_T+W_{D1}+W_{D2})/2)\}\cos\theta_1/\sin(\theta_1+\theta_2)\ (W_L/2)\cos\theta_1/(\cos\theta_1+\cos\theta_2) \quad (20)$$

Also, $T_{2R}=T_{1R}$, and $T_{2L}=T_{1L}$

As described above, the rope tensions $T_{01R}$, $T_{01L}$, $T_{02R}$ and $T_{02L}$ of the hoisting accessory wire ropes 31, 31', 32, 32', 39, 39' and 40, 40' vary with the traversing position of the hoisting accessory 47, 47' (container C) as do the rope tensions $T_{1R}$, $T_{1L}$, $T_{2R}$, and $T_{2L}$ of the traverser wire rope pairs 19, 19', 20, 20', 25, 25' and 26, 26'. That is, when the hoisting accessory 47 is caused to traverse most rightward, the rope angle $\theta_1$ increases, and the rope angle $\theta_2$ decreases. Thus, the tensions of the right-hand wire ropes 19, 19', 25, 25', 31, 31' and 39, 39' increase, while the tensions of the left-hand wire ropes 20, 20', 26, 26', 32, 32' and 40, 40' decrease. As a result, the leftward horizontal component of force on the hoisting accessory 47 (container C) becomes smaller than in the earlier technology, and the position at which the rightward and leftward horizontal components of force are balanced comes more rightward than in the earlier technology. Hence, the hoisting accessory 47 (container C) can be brought fully close to the crane leg as compared with the earlier technology. The traversing range of the hoisting accessory 47 widens, and the work efficiency of the crane can be increased without the necessity of upsizing the apparatus.

In the present embodiment, the right and left suspending wire ropes 55, 55' and 56, 56' as a pair paid out from the rotating drums 53, 53, and 54, 54' may be passed over the lower-position right and left rope pulleys as a pair and then connected to the traverser 23, and the hoisting accessory 47 may be suspended from the rope pulleys, as in the preceding embodiment. In this case, the total weight of $W_L$ of the hoisting accessory 47 and the container C can be shared between the hoisting accessory wire ropes 31, 31', 32, 32', 39, 39', 40, 40' and the traverser wire ropes 19, 19', 20, 20', 25, 25', 26, 26'.

[Third Embodiment]

Figure 3:
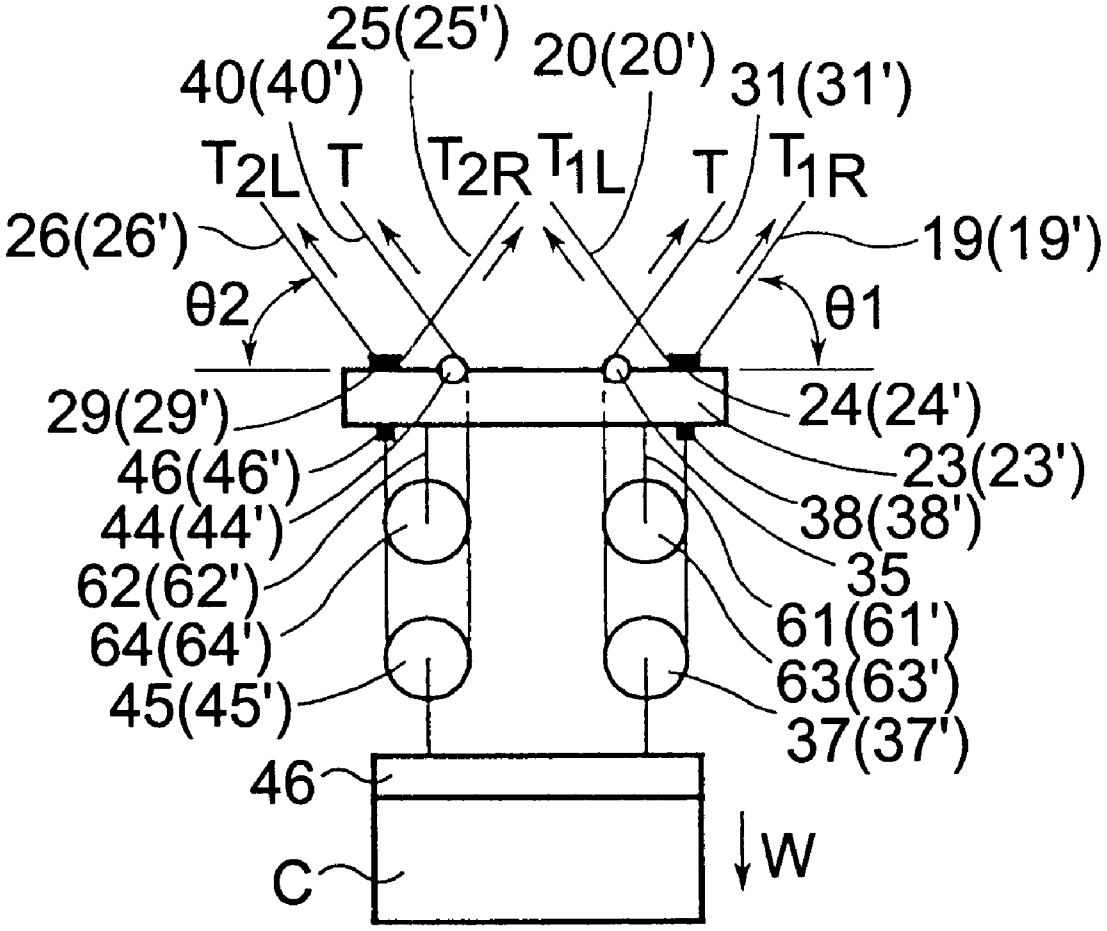
FIG. 3 is a schematic constitution drawing of a crane apparatus according to a third embodiment of the invention.
Figure 4:
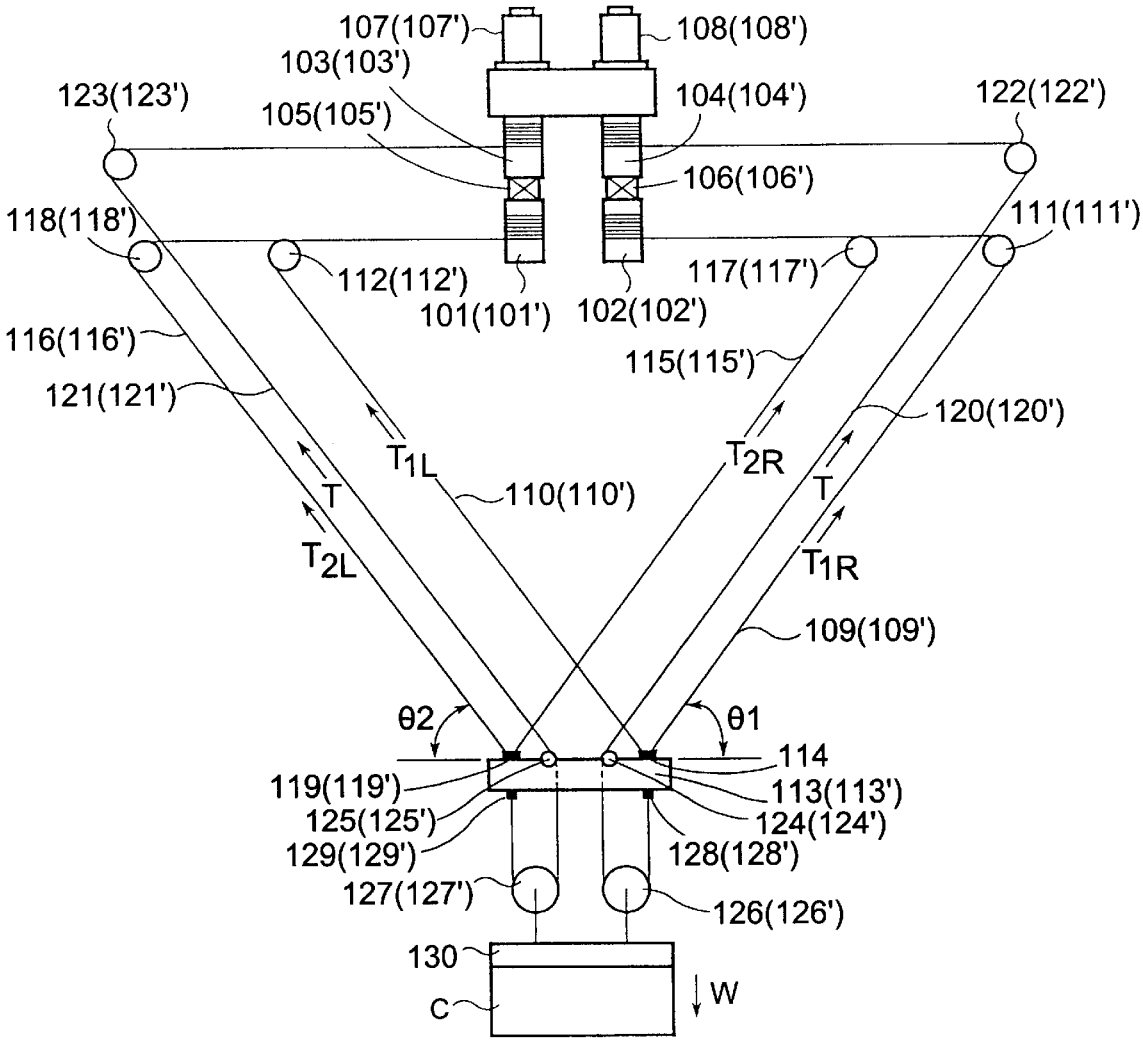
FIG.4 PRIOR ART
FIG. 4 is a schematic constitution drawing of a conventional crane apparatus.
Figure 5:
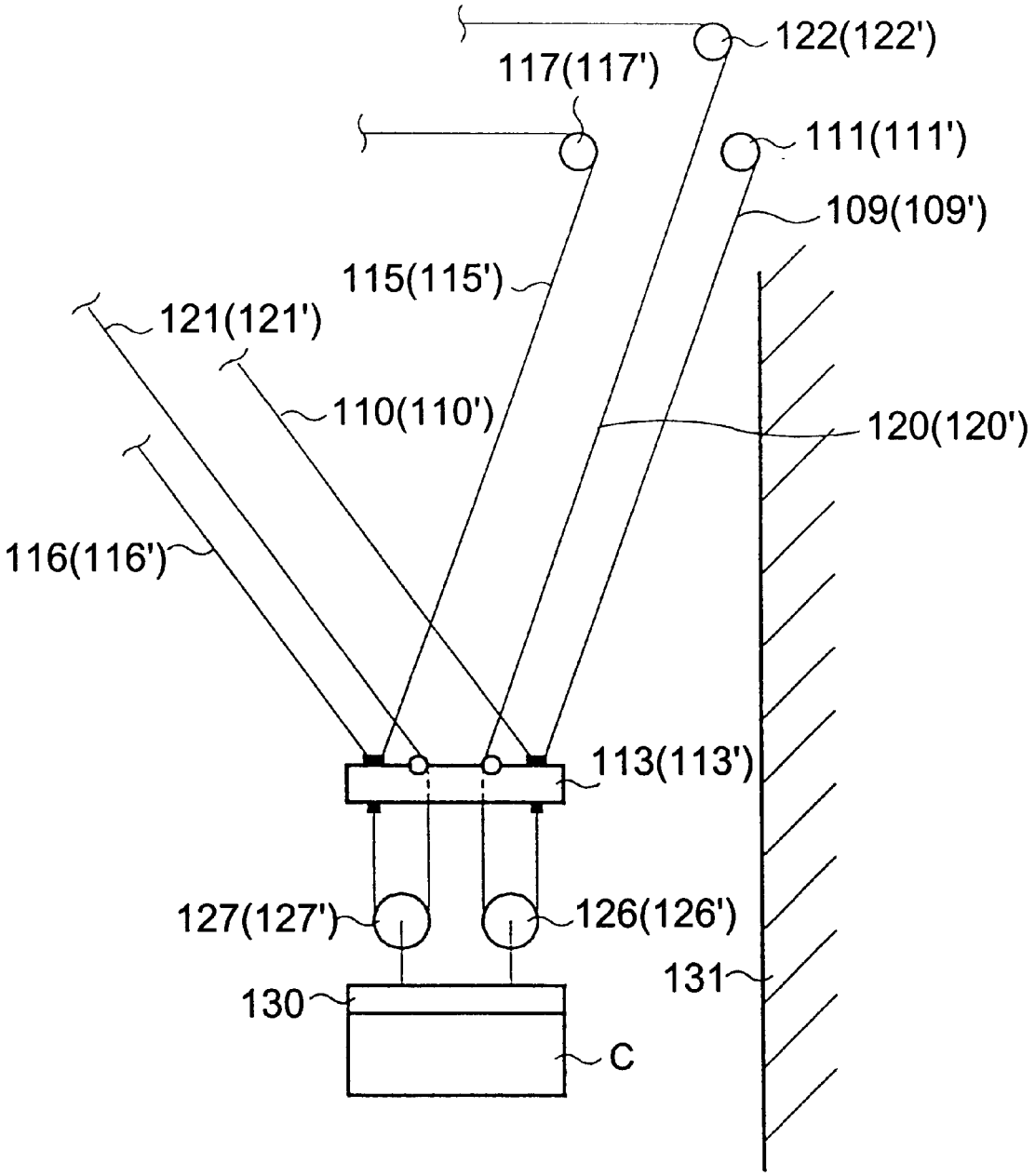
FIG.5 PRIOR ART
FIG. 5 is a schematic view of the conventional crane apparatus during a traversing action.

FIG. 3 schematically shows the constitution of a crane apparatus according to a third embodiment of the invention. Members having the same functions as explained in the aforementioned embodiment will be assigned the same reference numerals, and overlapping explanations will be omitted.

In the crane apparatus of the present embodiment, pairs of first right and left rope pulleys 63, 63' and 64, 64' are supported in a suspended manner from a traverser 23 by ropes 61, 61' and 62, 62', as shown in FIG. 3. A first hoisting accessory wire rope 31, 31' has other ends passed round the first right rope pulleys 63, 63' via right sheaves 35, 35' of the traverser 23, further passed over second right rope pulleys 37, 37', and then connected to a right connecting portion 38, 38' of the traverser 23. A second hoisting accessory wire rope 40, 40' has other ends passed round the first left rope pulleys 64, 64' via left sheaves 44, 44' of the traverser 23, 23', further passed over a second left rope pulley 45, 45', and then connected to a left connecting portion 46, 46' of the traverser 23. A hoisting accessory 47 capable of holding a container C is suspended from the second rope pulleys 37, 37' and 45, 45'. Hence, when only hoisting accessory drums (not shown) are rotated for a takeup action, the hoisting accessory wire ropes 31, 31', 40, 40' are taken up, whereby the container C held by the hoisting accessory 47 can be hoisted via the first rope pulley pairs 63, 63', 64, 64' and the second rope pulley pairs 37, 37', 45, 45'. Alternatively, the hoisting accessory wire ropes 31, 31', 40, 40' are paid out, whereby the container C held by the hoisting accessory 47 can be lowered via the first rope pulley pairs 63, 63', 64, 64' and the second rope pulley pairs 37, 37', 45, 45'. The traversing action of the hoisting accessory 47 is the same as in the aforementioned embodiment, so that its explanation is omitted.

In the crane apparatus of the present embodiment, the hoisting accessory wire ropes 31, 40 are connected to the traverser 23 via the first rope pulley pairs 63, 63', 64, 64' and the second rope pulley pairs 37, 37', 45, 45'. Thus, rightward and leftward horizontal components of force, which the hoisting accessory wire ropes 31, 31', 40, 40' impose on the hoisting accessory 47, can be decreased. That is, $$T=W/8$$

$$T_{1R}=(W/2)\cos\theta_2/\sin(\theta_1+\theta_2)-W/16$$

$$T_{1L}=(W/2)\cos\theta_1/\sin(\theta_1+\theta_2)-W/16$$

Also, $T_{2R}=T_{1R}$, and $T_{2L}=T_{1L}$

As described above, since the rope tensions T of the hoisting accessory wire ropes 31, 31', 40, 40' are decreased, the rightward and leftward horizontal components of force on the hoisting accessory 47 (container C) are decreased. Whereas the rope tensions $T_{1R}$, $T_{1L}$, $T_{2R}$ and $T_{2L}$ of traverser wire rope pairs 19, 19', 20, 20', 25, 25' and 26, 26' are increased, whereby the rightward and leftward horizontal components of force on the hoisting accessory 47 (container C) are increased. Thus, the position at which the rightward and leftward horizontal components of force are balanced comes more outward than in the earlier technology. Hence, the hoisting accessory 47 (container C) can be brought fully close to the crane leg as compared with the earlier technology. The traversing range of the hoisting accessory 47 widens, and the work efficiency of the crane can be increased without the necessity of upsizing the apparatus.

In the foregoing respective embodiments, the connecting portions 24, 24', 29, 29' and the sheaves 35, 35', 36, 36', 43, 43', 44, 44' of the traverser 23, the rope pulleys 37, 37', 45, 45', 63, 63', 64, 64', the first and second traverser wire ropes 19, 19', 20, 20', 25, 25', 26, 26', the first and second hoisting accessory wire ropes 31, 31', 32, 32', 39, 39', 40, 40', the traverser sheaves 21, 21', 22, 22', 27, 27', 28, 28', the hoisting accessory sheaves 33, 33', 34, 34', 41, 41', 42, 42', the rotating drums 53, 53', 54, 54', and the suspending wire ropes 55, 55', 56, 56' have been constituted as a pair composed of right and left members. However, they may be provided as a plurality of pairs.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A crane apparatus comprising:

traverser drums and hoisting accessory drums rotatably mounted on a support and normally and reversely rotatable by drive motors;

a traverser having a pair of right and a pair of left connecting portions, and a pair of right and a pair of left sheaves thereon;

a right pair of and a left pair of rope pulleys positioned below the traverser;

a first pair of right and a first pair of left traverser wire ropes each having an end taken up by the traverser drums, and each having another end connected to the right pair of connecting portions of the traverser;

a second pair of right and a second pair of left traverser wire ropes having an end taken up by the traverser drums, and having another end connected to the left pair of connecting portions of the traverser;

a first pair of right and a first pair of left hoisting accessory wire ropes, each rope having an end taken up by the hoisting accessory drums, and having another end passed over one of the right pair of rope pulleys via one of the right pair of sheaves of the traverser and then connected to the traverser;

a second pair of right and a second pair of left hoisting accessory wire ropes, each rope having an end taken up by the hoisting accessory drums, and having another end passed over one of the left pair of rope pulleys via one of the left pair of sheaves of the traverser and then connected to the traverser;

a pair of right and a pair of left traverser sheaves and a pair of right and a pair of left hoisting accessory sheaves for guiding the right pair of wire ropes to be parallel and the left pair of wire ropes to be parallel; and a hoisting accessory capable of attaching and detaching a load thereto and therefrom, and suspended from the right and left pair of rope pulleys.

2. The crane apparatus of claim 1, wherein the hoisting accessory drums are drivably connected to said drive motors, and the traverser drums are drivably connected to the hoisting accessory drums via clutches.

3. A crane apparatus comprising:

traverser drums and hoisting accessory drums rotatably mounted on a support and normally and reversely rotatable by drive motors;

a traverser having a pair of right and a pair of left connecting portions, and a pair of right and a pair of left sheaves thereon;

a pair of right and a pair of left rotating drums suspended from the traverser;

a first pair of right and a first pair of left traverser wire ropes, each rope having an end taken up by the traverser drums, and each rope having another end connected to the right pair of connecting portions of the traverser;

a second pair of right and a second pair of left traverser wire ropes, each rope having an end taken up by the traverser drums, and each rope having another end connected to one of the left pair of connecting portions of the traverser;

a first pair of right and a first pair of left hoisting accessory wire ropes, each rope having an end taken up by the hoisting accessory drums, and each rope having another end passed over one of the right rotating drums via one of the right pair of sheaves of the traverser;

a second pair of right and a second pair of left hoisting accessory wire ropes, each rope having an end taken up by the hoisting accessory drums, and each rope having another end passed over one of the left pair of rotating drums via the left pair of sheaves of the traverser;

a pair of right and a pair of left traverser sheaves and a pair of right and a pair of left hoisting accessory sheaves for guiding the right pair of wire ropes to be parallel and the left pair of wire ropes to be parallel; and a hoisting accessory capable of attaching and detaching a load thereto and therefrom, and connected to the respective pairs of right and left suspending wire ropes paid out from the respective right and left pair of rotating drums.

4. The crane apparatus of claim 3, wherein the hoisting accessory drums ar e drivably connected to drive motors, and the respective pairs of traverser drums are drivably connected to the hoisting accessory drums via clutches.

5. The crane apparatus of claim 3, wherein the respective pairs of hoisting accessory wire ropes and the respective pairs of suspending wire ropes are passed over the rotating drums in opposite directions.

* * * * *